US007219406B2

(12) United States Patent
Chui

(10) Patent No.: US 7,219,406 B2
(45) Date of Patent: May 22, 2007

(54) BUCKLE WITH SAFETY LATCH

(76) Inventor: Ming Kei Chui, 84 Page Avenue, Toronto Ontario (CA) M2K 2B7

( * ) Notice: Subject to any disclaimer, the term of this patent is extended or adjusted under 35 U.S.C. 154(b) by 204 days.

(21) Appl. No.: 11/145,583

(22) Filed: Jun. 6, 2005

(65) Prior Publication Data

US 2006/0272136 A1 Dec. 7, 2006

(51) Int. Cl.
*E05B 73/00* (2006.01)
*A44B 17/00* (2006.01)

(52) U.S. Cl. ..... 24/625; 24/593.1; 24/594.11; 24/598.1; 24/604; 24/605; 24/612; 24/614; 24/615; 70/58

(58) Field of Classification Search ..... None
See application file for complete search history.

(56) References Cited

U.S. PATENT DOCUMENTS 1,665,303 A * 4/1928 Hunter ..... 292/31
4,912,950 A * 4/1990 Crowle ..... 70/58
5,027,481 A * 7/1991 Frano ..... 24/606
5,548,879 A * 8/1996 Wu ..... 24/625
6,145,172 A * 11/2000 Bourdon ..... 24/625
6,163,942 A * 12/2000 Liao ..... 24/625
6,871,517 B2 * 3/2005 Bonelli et al. ..... 70/58
2004/0226150 A1 * 11/2004 Beletsky ..... 24/625

* cited by examiner

*Primary Examiner*—Jack W. Lavinder
(74) *Attorney, Agent, or Firm*—David W. Wong

(57) ABSTRACT

The plastic snap buckle is provided with a safety latch slidably mounted to an elongated bar of the male plug of the buckle. The latch member is generally rectangular shape having a length equal to the distance between two arcuate portions formed in the free end portion of two flexible arms of the male plug. The latch member may be slidably to locate between the arcuate portion of the flexible arm so as to prevent the flexible arms to be operated inadvertently or forcefully to release the engagement between the male plug and the female receptacle.

6 Claims, 5 Drawing Sheets

BUCKLE WITH SAFETY LATCH

BACKGROUND OF THE INVENTION

1. Field of the Invention

This invention relates to plastic snap buckles and more specifically relates to a snap buckle with a safety latch to prevent it from accidental release.

2. Background of the Invention

Plastic snap buckles are widely used for securing mounting belts for a large variety of bags and harnesses. Such snap buckle consists of a male plug and a female receptacle. The male plug is mounted to the end of one belt and the female receptacle is mounted to the end of the other belt such that the male plug and the female receptacle may be slidably engaged with one another to secure the two belts together. The male plug has two flexible arms which will engage with two side openings in the female receptacle when the male plug is slidably inserted into the female receptacle. To release the engagement, the flexible arms are pushed and held inwards towards one another while pulling the male plug away from the female receptacle. The engagement and release may be executed easily and quickly. Such plastic buckles are convenient to use and may be produced with relatively low cost. However, the buckle may become released accidentally when the flexible arms of the male plug are pushed in inadvertently either by hand or by abutting to other objects. More often, due to wear and tear in use, the engagement of the two components becomes less positive and it may be disengaged by a slight force exerted to the flexible arms of the male plug. Furthermore, when such buckle is used on the securing belt of a waist bag or wallet, the latter may be easily removed by some one forcibly gripping the flexible arms of the male plug to release the buckle to remove the worn bag. Thus, it becomes rather unsafe to use the buckle for such purposes. To prevent such forcible release and removal, safety latch may be provided in the buckle. However, theretofore, the safety latch constructions are rather complex in structure and are difficult to operate or the safety latch may itself be accidentally unlatched.

SUMMARY OF THE INVENTION

It is a principal object of the present invention to provide a snap buckle having a safety latch which operates effectively to prevent accidental or unintended release of the buckle.

It is another object of the present invention to provide a snap buckle having a safety latch which is itself protected from inadvertent release.

It is another object of the present invention to provide a snap buckle having a safety latch which is simple in structure yet is easy to operate.

BRIEF DESCRIPTION OF THE DRAWINGS

Other objects and advantages of the present invention will become apparent from the following detailed description of the preferred embodiments thereof in connection with the accompanying drawings in which.

DETAILED DESCRIPTION OF THE PREFERRED EMBODIMENT

Figure 1:
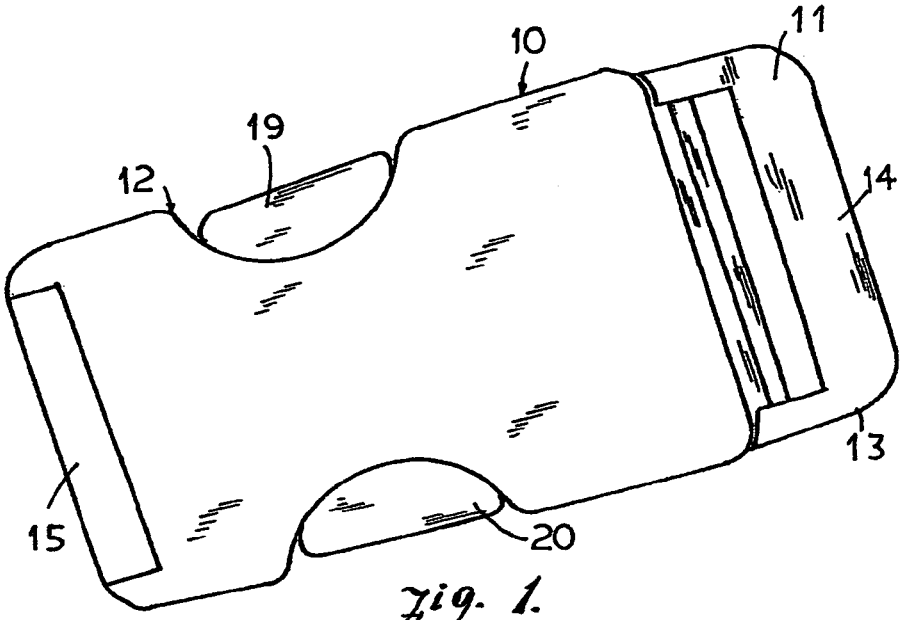
FIG. 1 is a perspective top elevation view of the snap buckle according to the present invention with the male plug engaged within the female receptacle.
Figure 2:
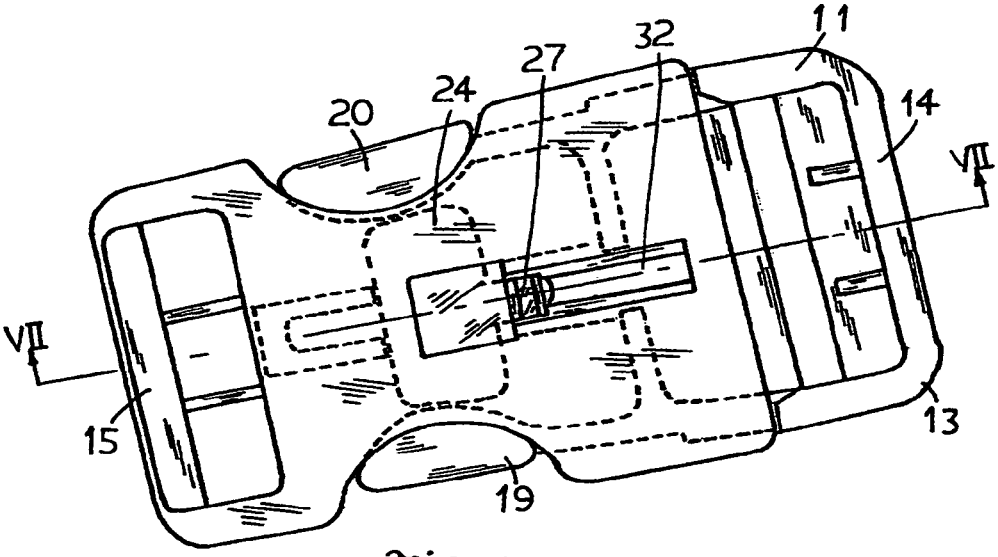
FIG. 2 is a perspective bottom elevation view of the snap buckle according to the present invention with the male plug shown in dotted line.
Figure 3:
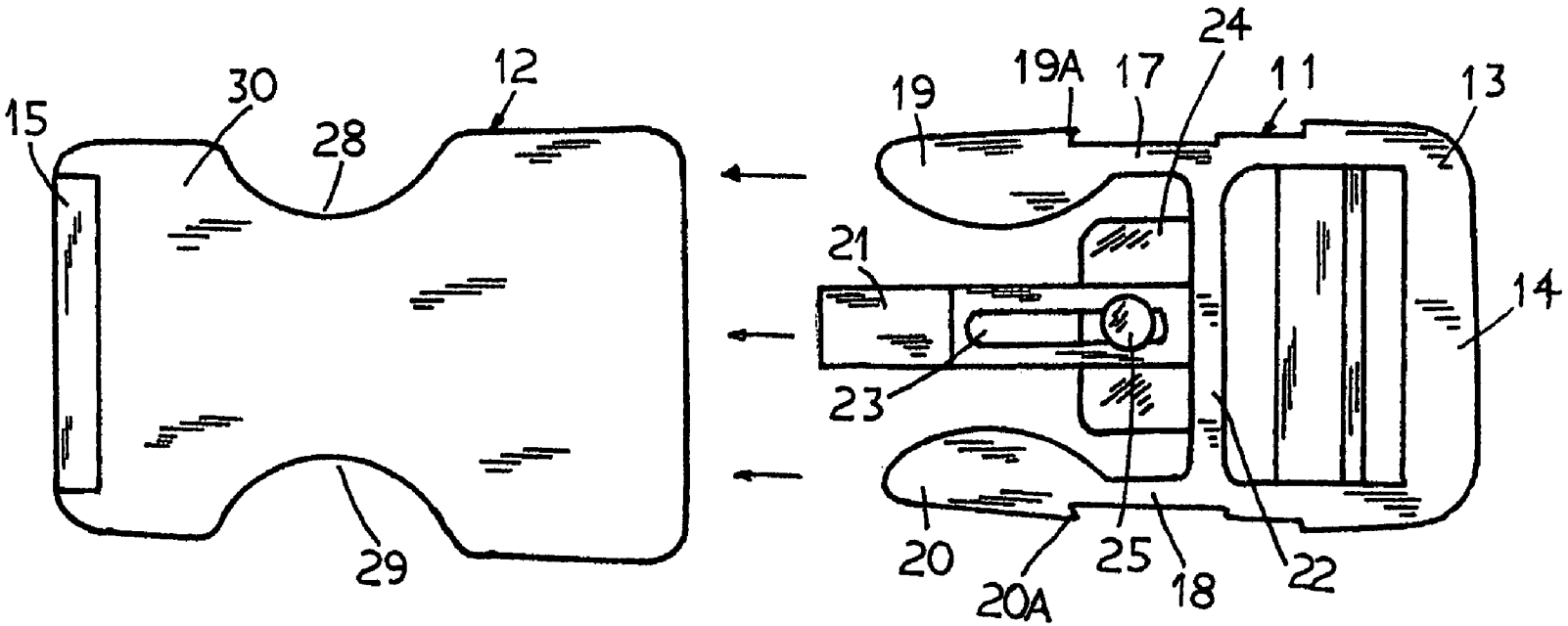
FIG. 3 is an exploded top elevation view showing the male plug and the female receptacle separated from one another.
Figure 4:
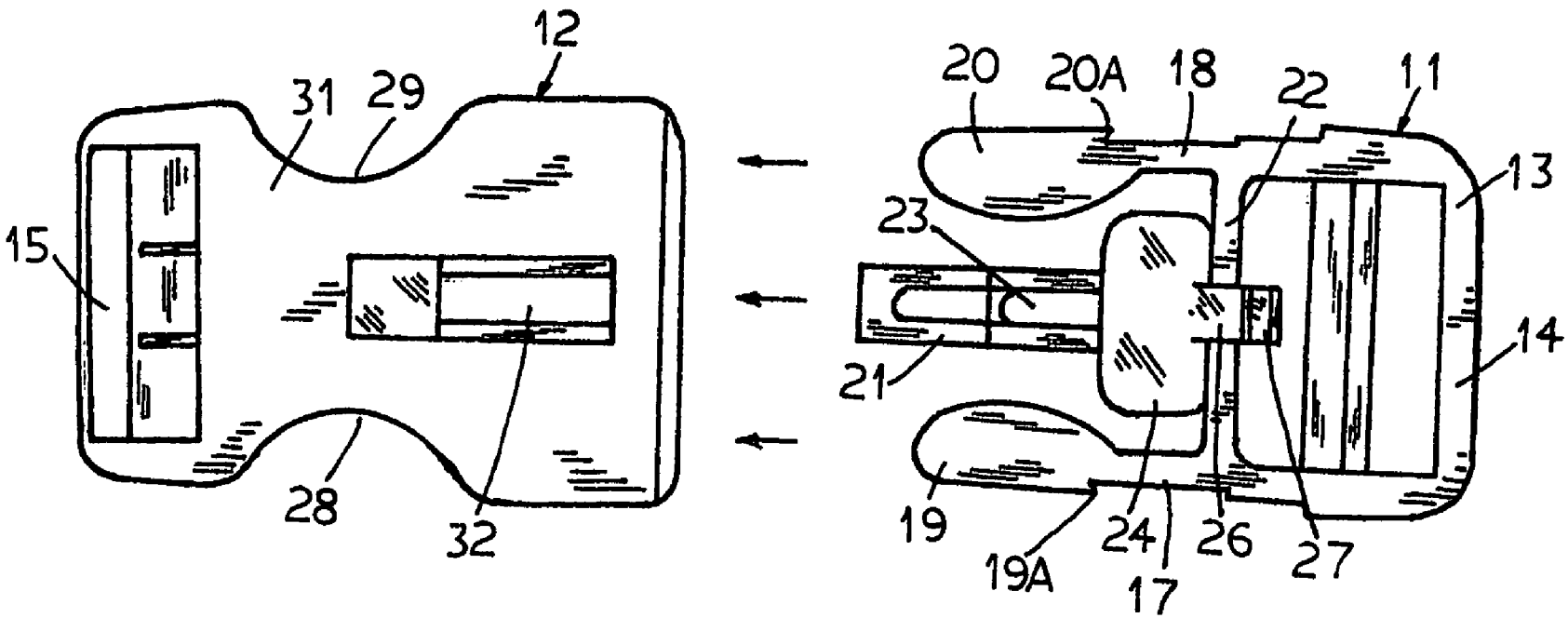
FIG. 4 is an exploded bottom elevation view of that shown in FIG. 3.
Figure 5:
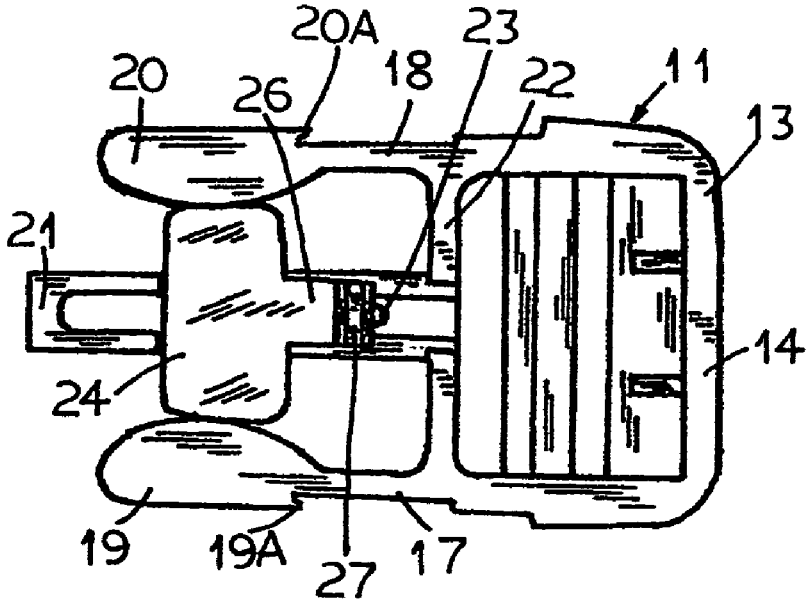
FIG. 5 is a perspective top elevation view of the male plug showing the latch member located at the latched position to prevent the flexible arms of the male plug from being pushed inwards.
Figure 6:
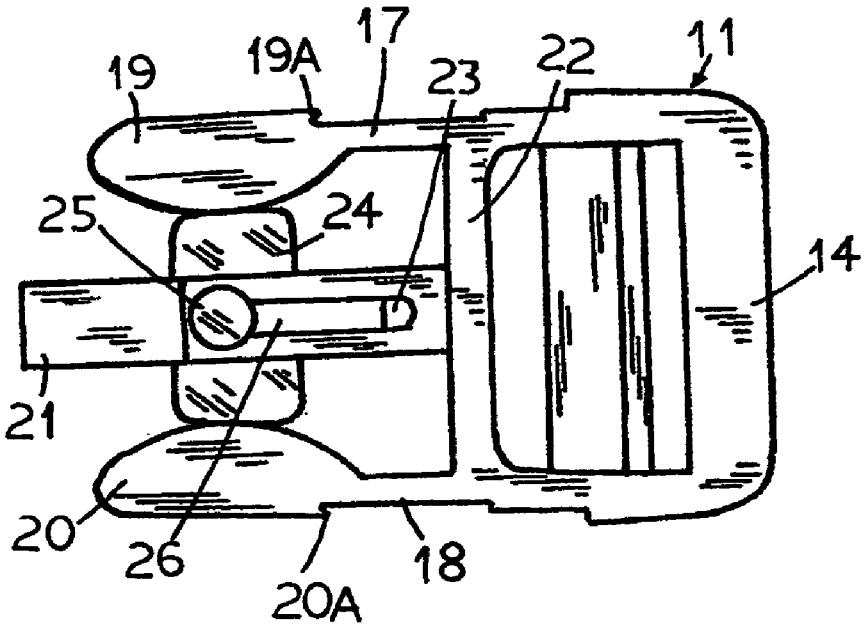
FIG. 6 is a perspective bottom elevation view of FIG. 5.
Figure 7:
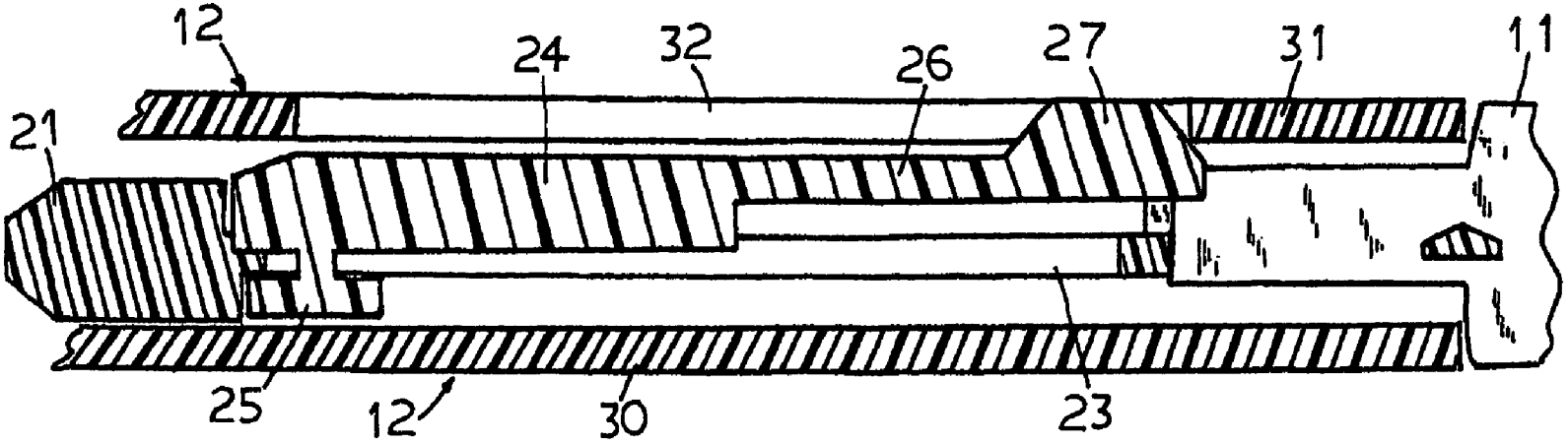
FIG. 7 is an enlarged cross sectional side elevation view along cross section line VII—VII of FIG. 2.

With reference to the drawings in which like reference numerals designate corresponding parts in the several views, the snap buckle 10 of the present invention includes a male plug 11 and a shell-like female receptacle 12 which may engage with one another for securing two belts together. The male plug 11 has a main frame 13 with an end mounting bar 14 adapted for mounting to an end of one belt and the female receptacle 12 also has an end mounting bar 15 adapted for mounting to an end of the other belt. These belts may be harness belts for mounting a carrying bag or a waist wallet or the like to a person. Two parallel spaced flexible arms 17 and 18 extend outwards from the main frame 13 opposite to the end mounting bar 14. The free ends of the flexible arms 17 and 18 have enlarged arcuate portions 19 and 20 respectively extending inwards towards one another and two rearwardly facing hooks 19A and 20A are formed on the outer side of the flexible arms 17 and 18 adjacent to the rear end of the arcuate portions 19 and 20. An elongated bar 21 is located at the middle of a cross bar 22 of the main frame 13 opposite to the end mounting bar 14 and equally spaced from the flexible arms 17 and 18. An elongated open slot 23 is formed in the center portion of the elongated bar 21.

A generally rectangular latch member 24 is slidably mounted on the elongated bar 21. The latch member 24 has an inverted T-shaped pin 25 located at its bottom surface. The inverted T-shaped pin 25 slidably engages with the open slot 23 for mounting the latch member 24 on the elongated bar 21 such that the latch member 24 may be slidable relative to the elongated bar 21. The latch member 24 has a length equal to the distance between the arcuate portions 19 and 20 of the flexible arms 17 and 18 so that when the latch member 24 is slidably located at the position between the arcuate portions 19 and 20 of the flexible arms 17 and 18, it prevents the flexible arms 17 and 18 from being pushed inwards towards each other. It can be appreciated that the latch member 24 may alternatively be oval, triangular or multi-sided in shape to provide the same function as long as it has a length equal to the space between the arcuate portions 19 and 20 of the flexible arms 17 and 18. The latch member 24 has a flexible extension arm 26 which normally extends rearwards parallel to the elongated bar 21 and it is flexible in the up and down directions relative to the elon gated bar 21 in a cantilever manner. A raised button portion 27 is formed at the end portion of the upper surface of the extension arm 26.

The female receptacle 12 has a shell-like body with two arcuate openings 28 and 29 formed at its two sides. The shell-like body has an upper wall 30 and a lower wall 31. The male plug 11 may be inserted into the female receptacle 12 through its front opening 32 until the hooks 19A and 20A of the male plug 11 engage with the rear edge of the arcuate opening 28 and 29 in a snap action to retain the two parts together.

An elongated slot opening 32 formed at the central portion of the lower wall 31 parallel to the central longitudinal axis of the female receptacle 12. The width of the slot opening 32 is equal to the width of the raised button portion 27 of the extension arm 26 such that when the male plug 11 and fully inserted into the female receptacle 12 the raised button portion 27 is slidably engaged with the slot opening 32. During the insertion of the male plug 11 into the female receptacle 12 the extension arm 26 is bent in a cantilever manner by the inner surface of the female receptacle until the raised button portion 27 engages with the slot opening 32 in a snap action to position slightly below the lower wall 31 of the female receptacle 12. After the male plug 11 and the female receptacle 12 have locked together in a snap action with the arcuate portions 19 and 20 of the male plug 11 engaged with the arcuate openings 28 and 29, the latch member 24 may be moved forward slidably to the position between the arcuate portions 19 and 20 by pushing the raised button 27 so as to prevent the flexible arms 17 and 18 from being pushed inwards towards each other to release the engagement between the male plug 11 and the female receptacle 12. The buckle 10 may be released only by sliding the latch member 24 forward to the position away from the space between the arcuate portions 19 and 20 of the flexible arms 17 and 18 of the male plug 11 so that the flexible arms 17 and 18 may be squeezed inwards to disengage from the arcuate openings 28 and 29 in order the male plug 11 and the female receptacle 12 may be pulled apart from the locked engagement. Since the raised button 27 of the latch member 24 is located in the slot opening 26 at the lower wall 31 of the female receptacle 12, it is not accessible unless the buckle 10 is turned over upside down. As the belt is tightly mounted to the body of the person, such action is difficult to carry out without the cooperation of the person wearing the device. Thus, it prevents the latch member 24 from being inadvertently operated by abutting to other object or the buckle being operated forcibly to remove the device worn by the person.

While the present invention has been shown and described in the preferred embodiment thereof, it will be apparent that various modifications can be made therein without departing from the spirit or essential attributes thereof, and it is desired therefore that only such limitations be placed thereon as are imposed by the appended claims.

What I claim is:

1. A safety snap buckle comprising:

a female receptacle having a shell-like body, two arcuate openings formed in two sides of said body, an elongated access slot opening formed in a lower wall of said shell-like body, a male plug having a generally rectangular frame and having two flexible arms extending in a mutually parallel manner from two sides of a front end of said frame forwardly, said flexible arms being flexible inwards towards each other, two arcuate portions formed on a free end of said flexible arms, two hook portions formed on an outer side edge of said flexible arms and adapted to engage with a rear edge of said arcuate openings of said female receptacle when said male plug and said female receptacle are slidably engaged with one another, an elongated bar formed in said male plug, said elongated bar extending forwardly from a cross bar of said frame and located parallel and spaced equal distance from said flexible arms, a latch member slidably mounted to said elongated bar, said latch member having a raised button portion adapted to engage with said elongated access slot opening at a lower surface of said female receptacle, said latch member having a length equal to a distance between said arcuate portions of said flexible arms, said raised button portion being operative for slidably locating said latch member selectively at a first position locating between said arcuate portions of said flexible arms and a second position away from said first position.

2. A safety snap buckle according to claim 1 wherein said latch member is generally rectangular in shape.

3. A safety snap buckle according to claim 2 including an elongated slot opening formed in said elongated bar, an inverted T-shaped pin provided at an underside of said latch member, said T-shaped pin slidably engaged with said slot opening of said elongated bar for mounting said latch member slidably on said elongated bar.

4. A safety snap buckle according to claim 3 including a flexible cantilever extension arm extending rearwardly from said latch member, and said raised button portion being formed on top of an end portion of said extension arm.

5. A safety snap buckle comprising:

a generally rectangular female receptacle having shell-like body, two arcuate openings formed in two sides of said body, an elongated access slot opening formed in a lower wall of said shell-like body, a male plug having a generally rectangular frame and having two flexible arms extending forwardly in a mutually parallel manner from two sides of a front end of said frame, said flexible arms being flexible inwards towards each other, two arcuate portions formed at a free end portion of said flexible arms, said arcuate portions having an inner edge spaced from one another a predetermined distance, two hooks formed in an outer side wall of said flexible arms and located adjacent to a rear end of said arcuate portions and adapted to engage with a rear edge of said arcuate openings of said female receptacle when said male plug is inserted into said female receptacle for locking said male plug and female receptacle together, an elongated bar formed in said male plug, said elongated bar extending forwardly from a cross bar of said frame and located parallel to and spaced equal distance from said flexible arms, a latch member slidably mounted to said elongated bar, a cantilever arm extending rearwardly from a rear edge of said latch member, said cantilever arm being flexible in up and down directions, a raised button portion formed on an undersurface at a free end of said cantilever arm, said raised button portion engaging with said access slot opening in said lower wall of said female receptacle when said male plug is inserted into said female receptacle, and said raised button portion being operative for slidably locating said latch member selectively at a first position located between and juxtaposed to said arcuate portions of said flexible arms and a second position away from said arcuate portions of said flexible arms.

6. A safety snap buckle according to claim 5 including an inverted T-shaped pin extending downward from an under surface of said latch member, said inverted T-shaped pin slidably engaging with an elongated slot formed in said elongated bar.

* * * * *